US005964685A

United States Patent [19]

Boland

[11] Patent Number: 5,964,685

[45] Date of Patent: Oct. 12, 1999

[54] ABDOMINALS AND ARMS MUSCLES EXERCISE DEVICE

[76] Inventor: Kevin O'Brien Boland, 5623 Massachusetts Ave., Bethesda, Md. 20816

[21] Appl. No.: 09/075,815

[22] Filed: May 12, 1998

Related U.S. Application Data

[63] Continuation-in-part of application No. 08/821,542, Mar. 21, 1997, Pat. No. 5,759,138.

[51] Int. Cl.[6] ..... A63B 21/02

[52] U.S. Cl. ..... 482/122; 482/125; 482/140; 482/124; 482/126; 482/121

[58] Field of Search ..... 482/122, 125, 482/140, 124, 126, 121

[56] References Cited

U.S. PATENT DOCUMENTS

| | | | |
|---|---|---|---|
| 4,591,150 | 5/1986 | Mosher | 482/122 |
| 4,726,580 | 2/1988 | Batiste et al. | 482/122 |
| 4,900,015 | 2/1990 | Dissinger | 482/121 |
| 5,176,601 | 1/1993 | Reynolds | 482/121 |
| 5,224,914 | 7/1993 | Friedman | 482/140 |
| 5,232,425 | 8/1993 | Miller et al. | 482/121 |
| 5,637,066 | 6/1997 | Chang | 482/121 |
| 5,669,862 | 9/1997 | Hayman | 482/140 |
| 5,669,863 | 9/1997 | Ho | 482/125 |

*Primary Examiner*—Jerome Donnelly
*Attorney, Agent, or Firm*—A. R. Eglington

[57] ABSTRACT

A lap-based exercise device for conditioning abdominals and arms is provided. It includes a horizontal first pair of parallel members, which pair defines an elongate trough that concurrently receives one end of a rigid spanner bar and a linked one end of an associated band tensioning means. The other end of the spanner bar is pinned to a second pair of upstanding, spaced apart members pressing the torso, with such upstanding members being linked at their lower ends to the longitudinal ends of the first pair via a second torso-side crossbar. A third crossbar is pinned to the outer longitudinal ends of the first parallel pair and includes a pair of manually grippable means for activation of the device. Upon curling movement of the grippable means toward the user torso, the spanner bar and the operatively linked tensioning means provide the counter resistance which allows for a smoother range of arcuate arm motion for the exerciser. A chest-initiated movement involves the chest moving towards the user lap for abdominals exercise and a hand-initiated movement involves the leg oriented cross bar moving towards the user's chest.

10 Claims, 14 Drawing Sheets

ABDOMINALS AND ARMS MUSCLES EXERCISE DEVICE

CROSS-REFERENCE TO OTHER APPLICATIONS

This is a continuation-in-part of my allowed co-pending patent application U.S. Ser. No. 08/821,542, filed Mar. 21, 1997, now U.S. Pat. No. 5,759,138, 1998.

FIELD OF THE INVENTION

The present invention relates to a portable exercise device adapted for selective human muscle conditioning and development.

BACKGROUND OF THE INVENTION

The need for practical and efficient devices suited for muscular toning and human body conditioning is a long established one. There are a variety of exercise devices, including powered machines, that selectively challenge different sets of body muscles. One area of sought exercise is directed to the abdominal, biceps, and triceps muscle sets. One such device described in the patent literature as is described in U.S. Pat. No. 5,232,425 (granted Aug. 3, 1993 to J. V. Miller et al). The Miller patent teaches a device that involves direct, over the inherent range of motion for the prior art device, that its resistance level increases linearly, as opposed to a preferred constant plus consistent resistance level throughout the device range of motion.

The prior art device lacks the mechanical features and architecture that can provide biceps toning in the course of using a curling motion. This feature is made more evident by resort to FIGS. 11–17, of Miller on its one preferred embodiment. FIGS. 11 and 12 show the extreme postures effected in using the device upright and crouched. Looking to Miller's FIGS. 15, and 16, an elastic band 124 is rigged over spaced-apart, opposing hook ends 120/134, so that user exertion on cross bands 40/41 results in a linearly increasing resistance as the finite length band 134 is extended. Miller also lacks a structural element positioned perpendicular to the user's body, thereby precluding a curling exercise.

It is a principal object of the present invention to provide a portable abdominal and arms exercise device that can be used alternately for abdominal toning, biceps muscle toning, forearm muscle toning, and triceps muscle toning by simple realignment of its operating position.

It is another object of the invention to provide an exercise device which incorporates a preferred constant resistance level feature occurring throughout the defined range of motion for the device user.

It is still another object of the invention to provide a device employing a linkage-based system versus a direct resistance system yielding a lineal and consistent resistance throughout its range of motion.

A yet further object of the invention is to provide a portable unit that folds up for easy shipment and/or storage.

It is a still further object of the invention to provide a device which precludes the need for positioning of the hands adjacent the user's chest (as seen with Miller '425 FIGS. 11 and 12), rather by steadying the device just within the user thighs, thus making for a concise and focused abdominal exercise.

SUMMARY OF THE INVENTION

According to the present invention, there is provided an exercise device adapted to alternately condition four different sets of muscles by relying on a rolling lever type of mechanism coupled with a linkage-based, counter resistance means, which configuration allows for a consistent and smoother range of motion for the exerciser. The new device includes an elongate first pair of parallel rigid members, serving as a lap-based component, which first pair also define a sheltered, elongate trough that receives pivotally therein, one longitudinal end (lower) of a rigid spanning bar and associated tensioning means; the other longitudinal end (upper) of the spanning bar is pivotally pinned to a shorter cross-bar, which cross bar is itself mounted straddling an upstanding second pair of spaced-apart, but conveniently converging, rigid members; with the upstanding second pair of members being anchored at their lower longitudinal ends to the lap-engaging, longitudinal ends of the elongate first pair of members.

The pair of converging upstanding members, optionally arcuately bowed in this middle segment, are conjoined at their upper longitudinal ends, and are pinned to a transverse, rigid cross-bar, which horizontally-aligned bar is positioned against the user's chest, during either of the crunching or curling exercises (FIGS. 1 and 2). At the outer (distal) longitudinal end of the lap-based first pair of members, there is centered a third elongate, rigid cross bar, which cross bar further includes a set of manually grippable means for activation of the exercise device, while the same device is supported in the seated user's lap, and resting against his chest. This gripping means cooperates with the opposing end of the first pair on the transverse bar, which is tucked across the horizontal body line defined by the joining of the lap and abdomen. The grippable means themselves comprise upwardly-oriented, opposing terminal segments of the distal perpendicularly-aligned bar.

As noted, the single spanning bar terminates within the trough of the first pair of parallel members and is at its lower end adapted to affect reciprocal linear movement therein, responding to user's exertion made on the gripping bars in a closing direction. The spanning bar lower end is concurrently tied to a horizontally-aligned, tensioning band, which provides the counterforce (resistance level) to the user's force being exerted on the grippable means over the device range of motion. An alternative means for the counterforce would be a hydraulic cylinder on a spring-based device.

The upper cross member is preferably provided with a pair of sleeve-type cushion elements that serve to ease the compression on the user's chest, occurring while he is exerting either crunching or curling effort on the gripping handles.

The lap-based (centered) first pair of parallel members are each further provided with a linear channel disposed lengthwise of its inner surface with the resulting opposing channels thus presenting a running track for a rolling-mounted short crossbar, which is pinned to the lower end of the spanning bar, so as to engage same in a sliding manner. This form of flexible linkage for the spanning member permits it to move reciprocally within the device trough, in response to the countervailing forces, being first exerted on such spanning member by the operatively attached elastic band and concurrently, but intermittently, by the upstanding second pair of converging members, as the linked crossbar that is chest-side is swung arcuately toward the trip handle cross member on the outer end by an exerciser, thus moving the spanning bar counter to the elastic band tension.

Generally, abdominal and biceps muscle sets strengthening are afforded by the user's of the handle ends of the distal cross-member, and then chest pushing the upper cross member (resistance bar) in a downward arc range of motion toward the user's closed lap sides (see FIG. 1). Similarly so, with the curling exercise, except that the distal grip handles are drawn upwardly towards the chest (see FIG. 2). In curls, palms are up for biceps extension, and palms down for forearm extension. While the abdominal and biceps workups have a reciprocal range of motion, for the triceps exercise, the device itself is first rotated 90° forwardly to the operating mode seen in FIG. 3. After securing it firmly against the user's thighs (to eliminate any lap sliding), with hand palms up, the grip handles are pulled inwardly towards the user's lap, to perform the triceps exercise. Thusly, this single device is adapted to serve to provide toning for the abdominal, biceps, and triceps muscle sets.

DETAILED DESCRIPTION OF PREFERRED EMBODIMENT

Figure 1:
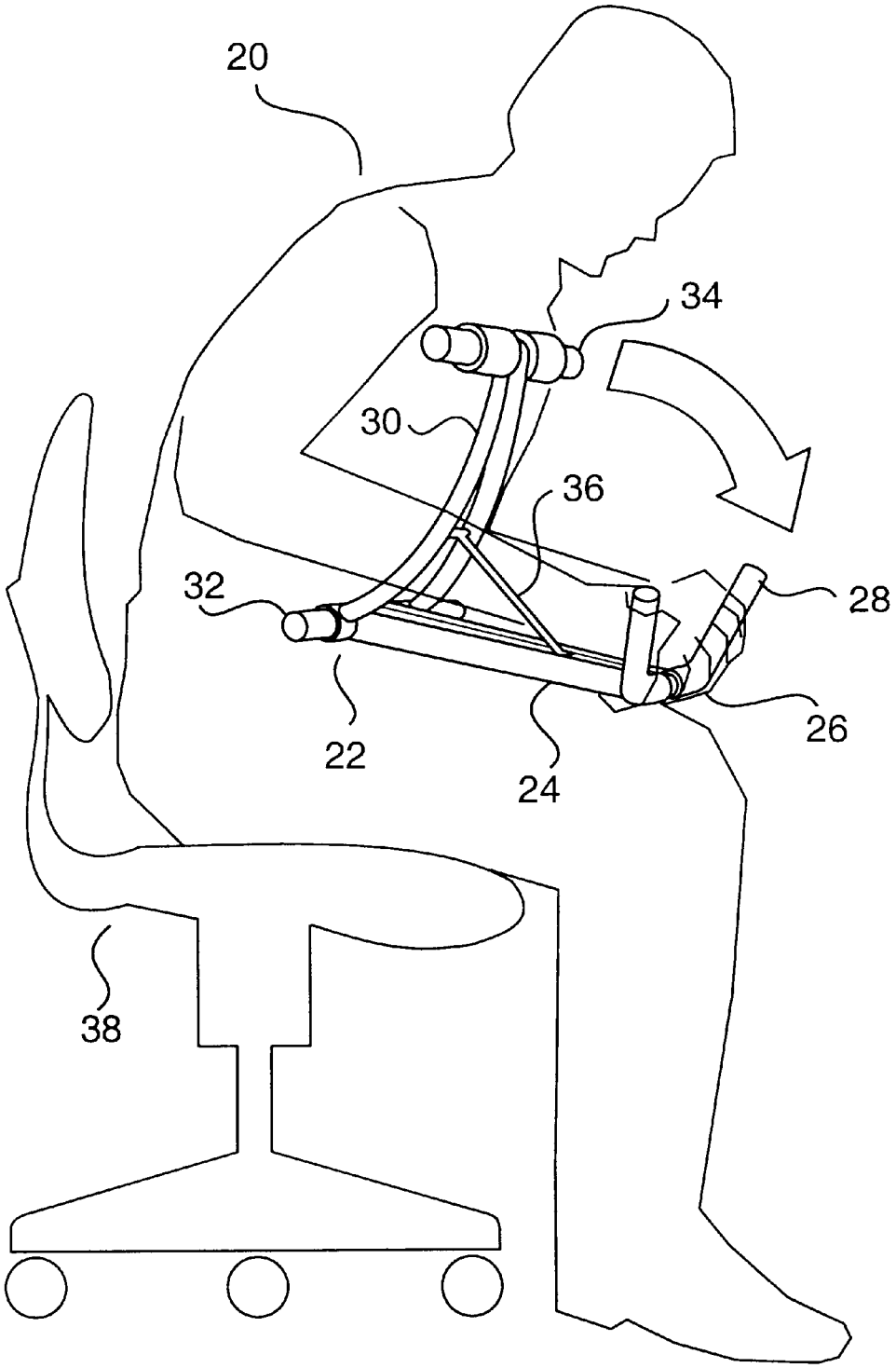
FIG. 1 is a schematic perspective view of a male exerciser (in phantom) employing the inventive device in a crunching (abdominals) exercise.

While the present invention is susceptible to some modifications so to effect the pretensioning aspect of the preferred embodiment, which is depicted in the drawing, it will be described in detail. It should be understood, that there is no intention to limit the depicted invention to the particular structure which is described here in detail, but it is intended to embrace modified constructions and functional equivalents falling within the scope of the appended claims.

Referring now to the drawing, as shown in each of the schematics of FIGS. 1–4, it is an ABS and Arms exercise device. In each view, the device is engaged by an exerciser. It includes: the portable lap-positioned device, generally 22, having a lap-supported, elongate, linear pair of sidewall members 24L/R; a distal, elongate cross-member 26 with terminal upswept handles 28; a lower elongate crossbar 32 (tucked into the exerciser's lap); an upstanding pair of support members 30; an upper elongate crossbar 34 for members 30, resting against the upper torso; and an inclined single spanner-bar 36, which is functionally linked between the upstanding pair 30 of members and a device tensioning mechanism (not seen), conveniently located in the trough of members 24L/R. The user is necessarily seated on a chair 38 while exercising. Note that in FIG. 1, the user's hands should be oriented appropriately to maintain the lap position for the device 22 during exertion.

In FIG. 1, the user is engaged in a leaning, forward motion, while his upper torso pressures crossbar 34 concurrently with bracing of the manually-gripped handle bar 28, thus retaining the device static while supported in the lap of the user. The arcuate/reciprocal range of motion stresses and conditions primarily the abdominal muscles during the "crunching" effort, and its complemental return to upright (which is effected through several repetitions).

Figure 2:
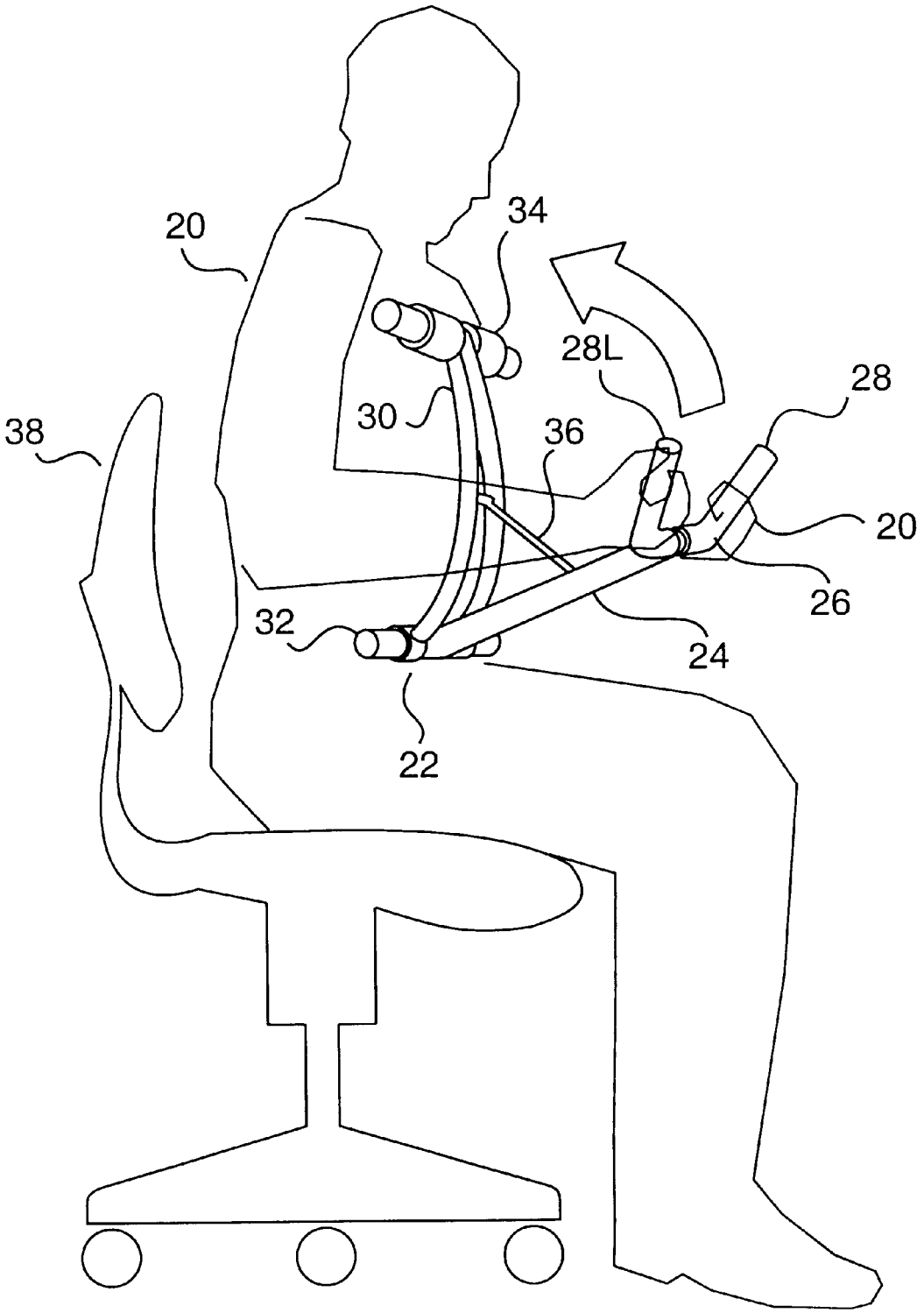
FIG. 2 is another perspective view of a male exerciser employing the similarly aligned inventive device but in a curling (biceps) conditioning exercise.

In the schematic view of FIG. 2, the user is in a seated, upright position with his upper torso and lap both serving as a bracing posture for device 22, but now while a curling motion is carried out. The biceps conditioning effort is effected by manually drawing the handles 28 toward the upper torso against the resistance provided by upwardly shifting spanner-bar 36. Upon release of the manual effort, the device returns to the at-rest gap between handles 28 and upper crossbar 34, until the next repetition.

Figure 3:
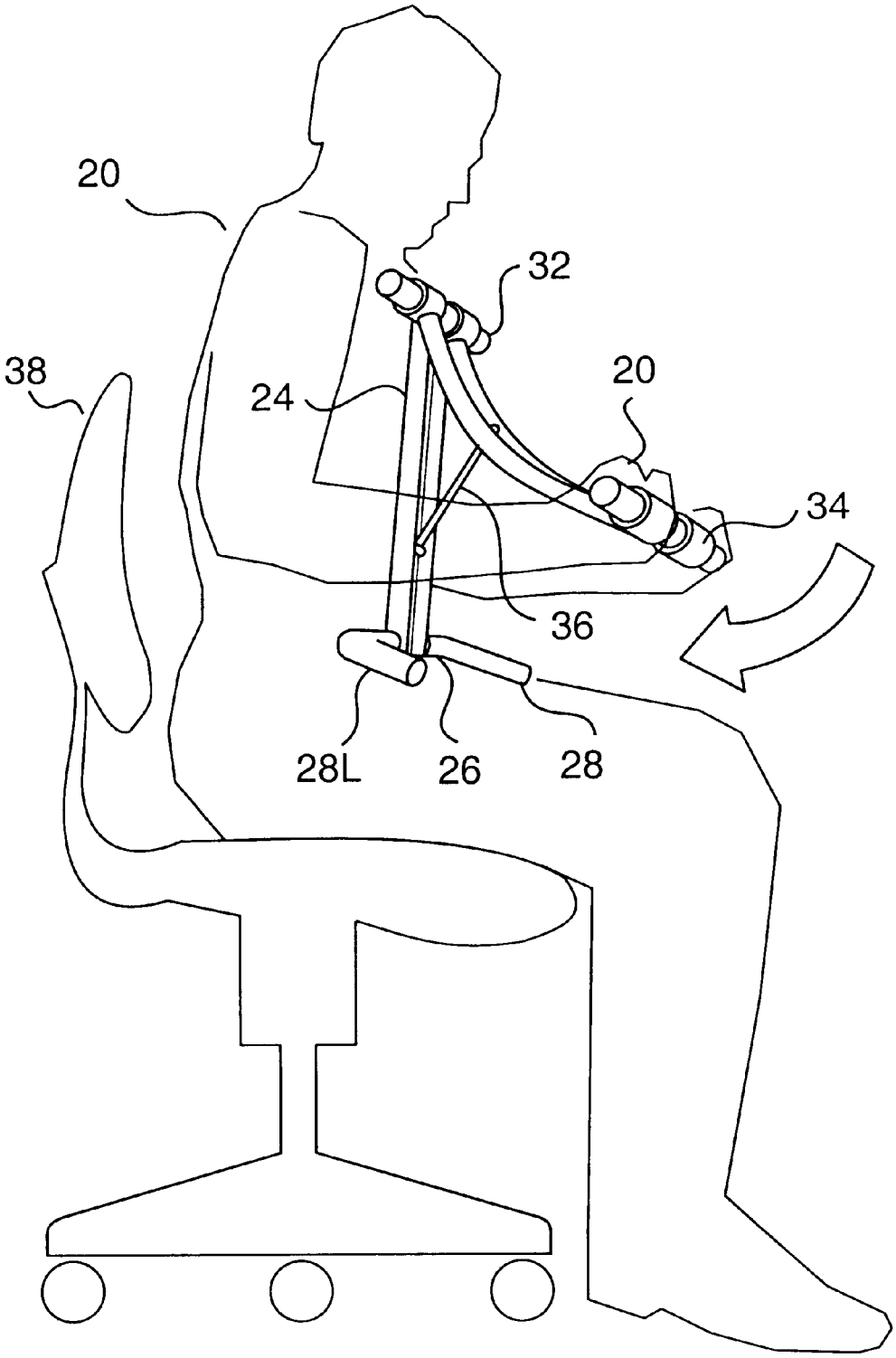
FIG. 3 is another schematic perspective view of a male exerciser employing the now realigned inventive device in a triceps conditioning exercise.

In the schematic view of FIG. 3, the device 30 has been realigned to permit a triceps conditioning exercise. It is rotated 90 forwardly (clockwise) so that the upright handles 28 straddle the user's lap and the upper crossbar 34 then becomes the manually grippable, muscle exertion bar. The device is further steadied by the other crossbar 32, now resting against the upper torso. The inward-downward effort made by the underlapped hands (palms up?) 20H is to draw crossbar 32 towards the user's lap, relying primarily on his triceps (see arrow), which are exerted against the resistance of spanning bar 36. Upon relaxation, the crossbar 34 returns to the at-rest gap, shown between handles 28 and crossbar 34, until the next repetition.

In all of the described exercises, the manual effort upon a cross member in the defined arcuate range of motion causes spanning bar 36 to move along a track-follower assembly (to be described) against the countervailing tension imposed thereon by an operatively-connected tensioning band (also to be described). In all three, upon manual release, the follower assembly returns to its at-rest position as defined by the unstretched length of an associated tensioning band, or its equivalent resilient tensioning structure.

Figure 4:
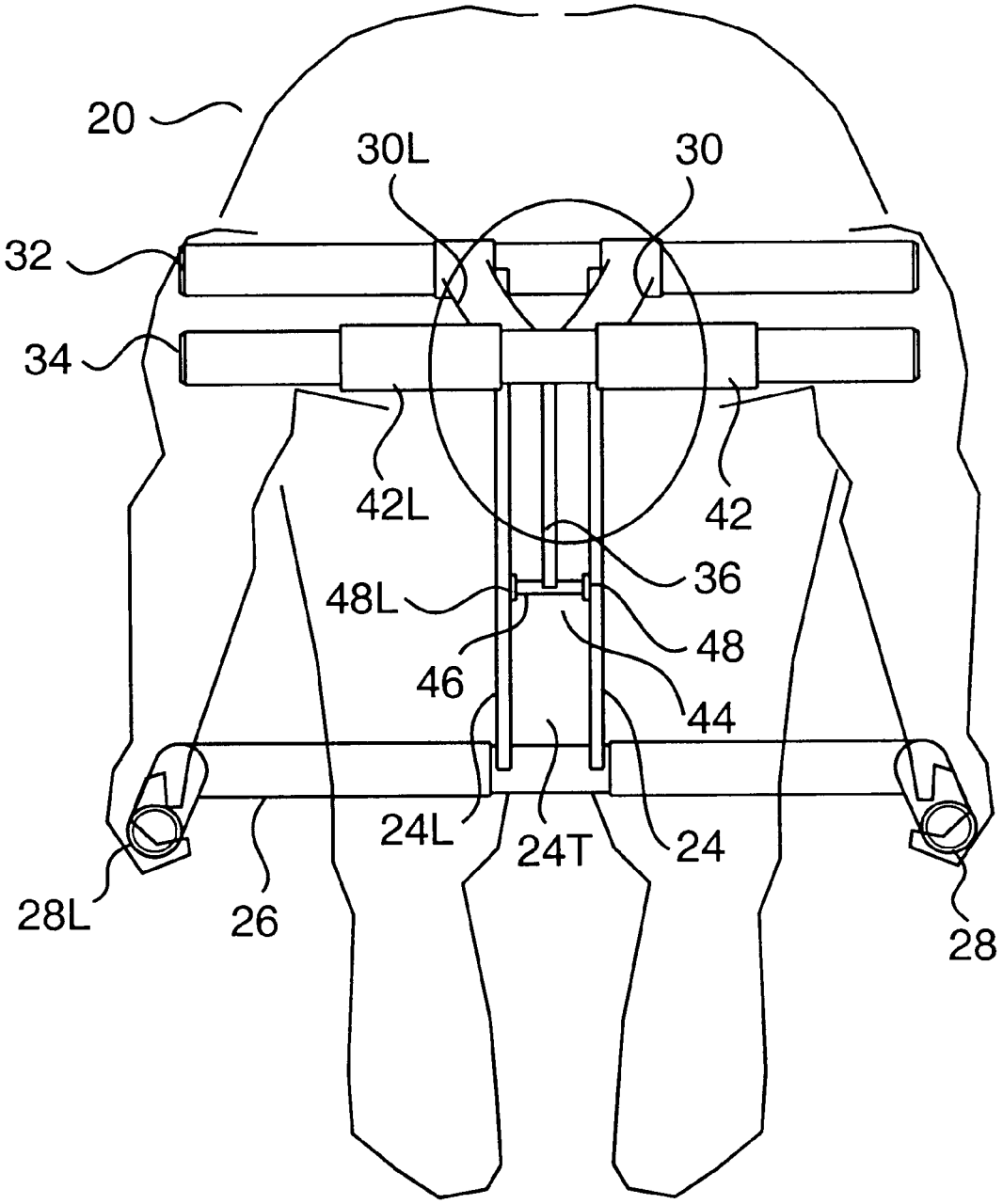
FIG. 4 is a top plan view of the inventive device as aligned in the exercises of FIG. 2.

The top plan schematic view of FIG. 4 depicts the user engaged with the device while in the curling exercise of FIG. 2 (palms facing inward?) about the handles 28. The paired upstanding members 30L/30R are seen as upwardly converging to be secured at their union to crossbar 34, which bar is further provided with cushioning sleeves 42L/R for minimizing pressure discomfort on the upper torso. Central spanner bar 36 is seen with its lower longitudinal end attached to a track-follower assembly 44, which assembly is composed of a short crossbar 46 and its operatively attached, outer-end rollers 48L/R. As is apparent, assenbly 44 moves reciprocally within a longitudinal trough 24T of member 24 (not seen) responding to the movement of spanner bar 36; which bar, in turn, responds to partial closing of the space between distal handles 28LJR and cushioned upper cross member 34. Lower cross member 32 is tucked into the crease between the user's lap and his torso for device stability and action.

Figure 5:
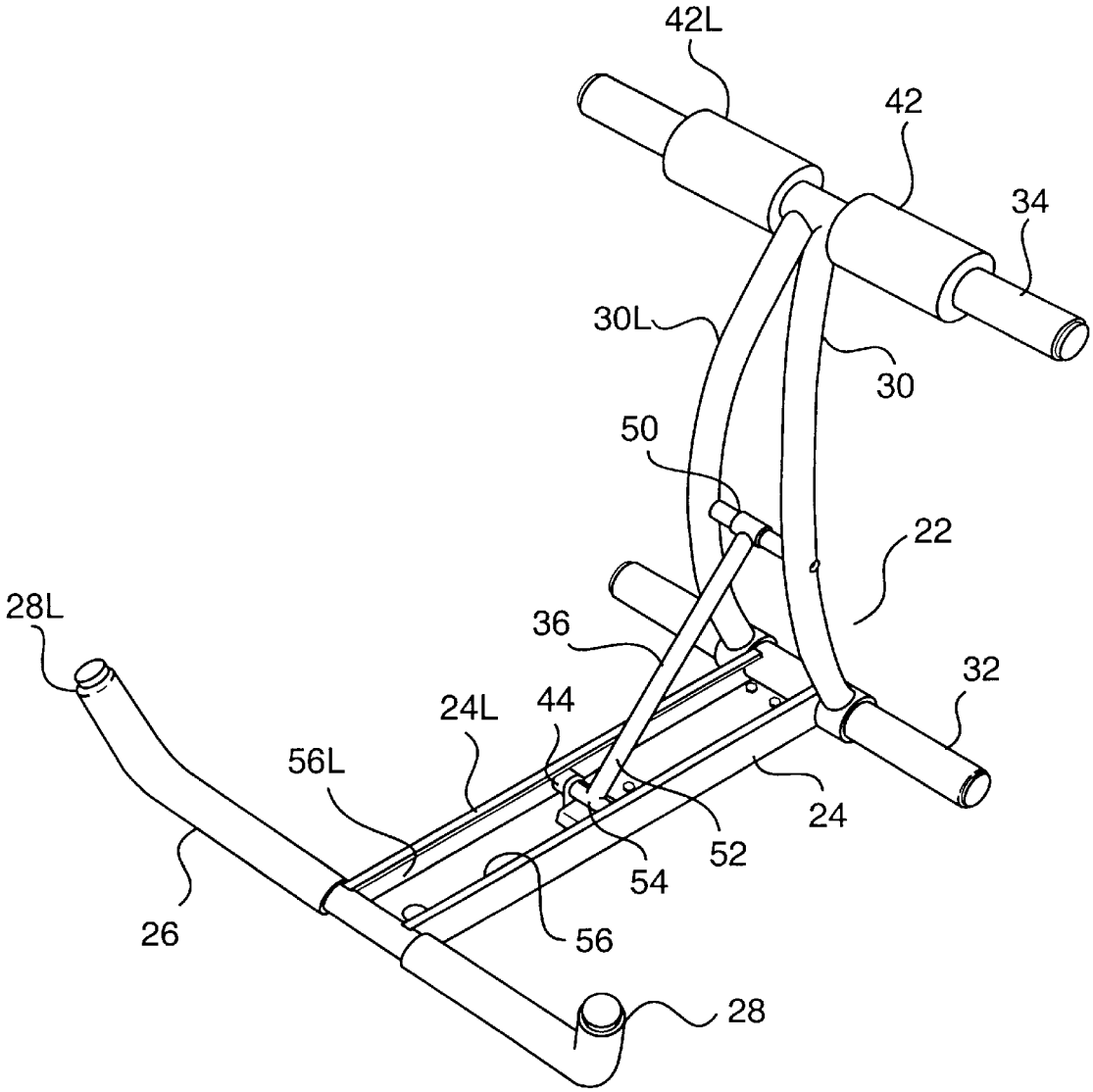
FIG. 5 is a perspective view of the inventive device of FIGS. 1 to 3, now seen from the side normally distal from the exerciser's chest, but standing alone.

The perspective view of FIG. 5 shows the exercise device 22, standing alone, as it would be spatially-oriented to conduct either of the crunching or curling exercises shown in FIGS. 1 and 2 (and 4). A short cross member 50 straddles and interconnects between converging upright members 3OL/R intermediate of their upper and lower longitudinal ends. Member 50 is centrally attached to the upper end of spanner bar 36 and is adapted to pivot with it as the latter tracks trough 24T; while the lower longitudinal end 52 of spanner bar 36 is likewise adapted to pivot at its lower longitudinal end. Spanning bar end 52 is linked to hollow cross member 54, which is positioned transversely of the spaced-apart parallel sidewalls 24L/R. The opposing inner surfaces of paired sidewalls 24L/R are each provided with a linear channel 56L/56R, which channels are slidingly engaged by the outer-end rollers 48L/R of follower assembly 44. Assembly 44 is preferably configured as a bracket-type platform, with laterally aligned upstanding lugs, that accommodate the axle (not seen) of roller set 48L/R within member 54. Disposed longitudinally in the proximal segment of trough 24T is a horizontally-aligned resilient tensioning band 58.

Band 58 is secured (detachable) at its proximal (torso-side) end to the center segment of proximal cross member 32, and it is secured at its distal longitudinal end (detachably) to the proximal side of assembly 44. In the unextended position, band 58 is sized to define the preferred intermediate position for follower assembly 44, when not tracking within the dual sidewall channels 56L/R of elongate U-shaped member 24. As the handles 28 are drawn toward upper cross bar 34, this causes spanning bar 36 to move its lower end 52 outwardly, moving associated follower assembly 44 towards distal cross bar 26, but concurrently doing so against the limiting counter-tension imposed by stretching of resilient band 26. Clearly, as either the crunching or curling exertions on the cross member are relaxed, the spanning bar 36 draws the follower assembly 44 back to its at-rest position, as is depicted.

Figure 6:
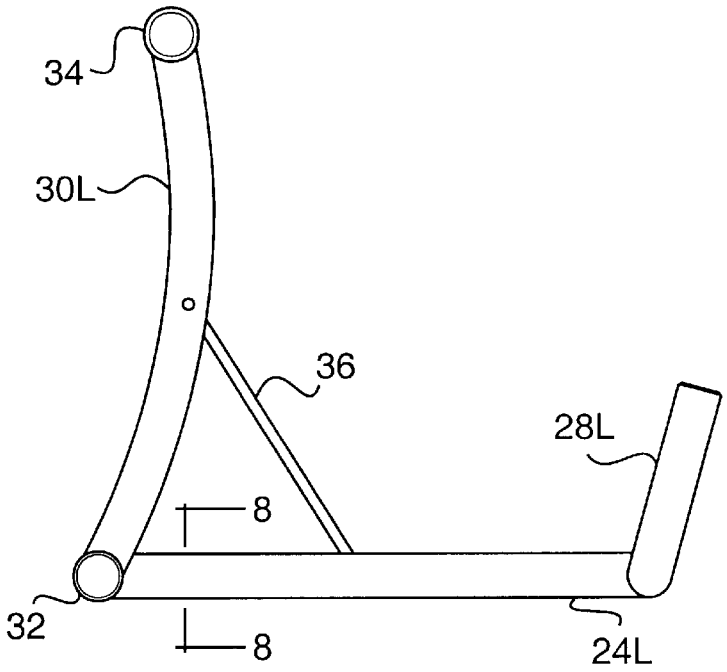
FIG. 6 is a side elevational view of the inventive device, standing alone.
Figure 7:
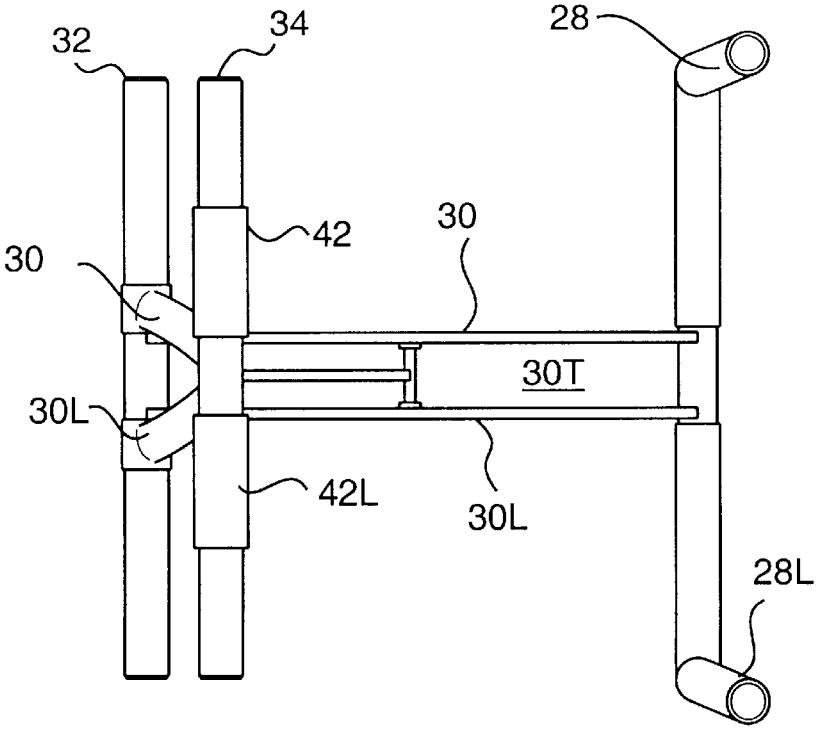
FIG. 7 is a top plan view of the inventive device, as seen in FIG. 5 standing alone.

In FIGS. 6 and 7, are shown side elevation and top elevation views, respectively, of the inventive device, standing alone, but further depicting the operative, central reciprocating linkage, that provides the uniform resistance needed for the effective use of the device in varied muscle set conditioning.

Figure 8:
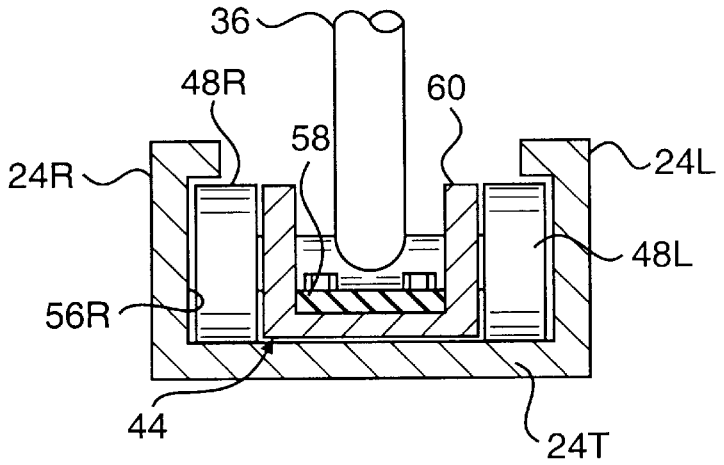
FIG. 8 is a vertical sectional view taken along lines 8—8 in FIG. 6 of the components of the elastic bands, preferably mounted within the trough of the lap-based member, which resilient means functions to provide the counterforce (resistance level) to the force exerted by the movement of the gripping bars of the device.

The vertical sectional view of FIG. 8, taken behind the follower mechanism 44 (proximal span), which mechanism is functionally positioned between the elongate member sidewalls 24L/R. It better depicts the operative components, including (actuating) spanner member 36 attached to transverse hollow member 54, the opposing linear channels 56L/R recessed in member sidewalls 24L/R, tracking rollers 48L/R, axle support bracket 60, and bolted tensioning band 58.

Figure 9:
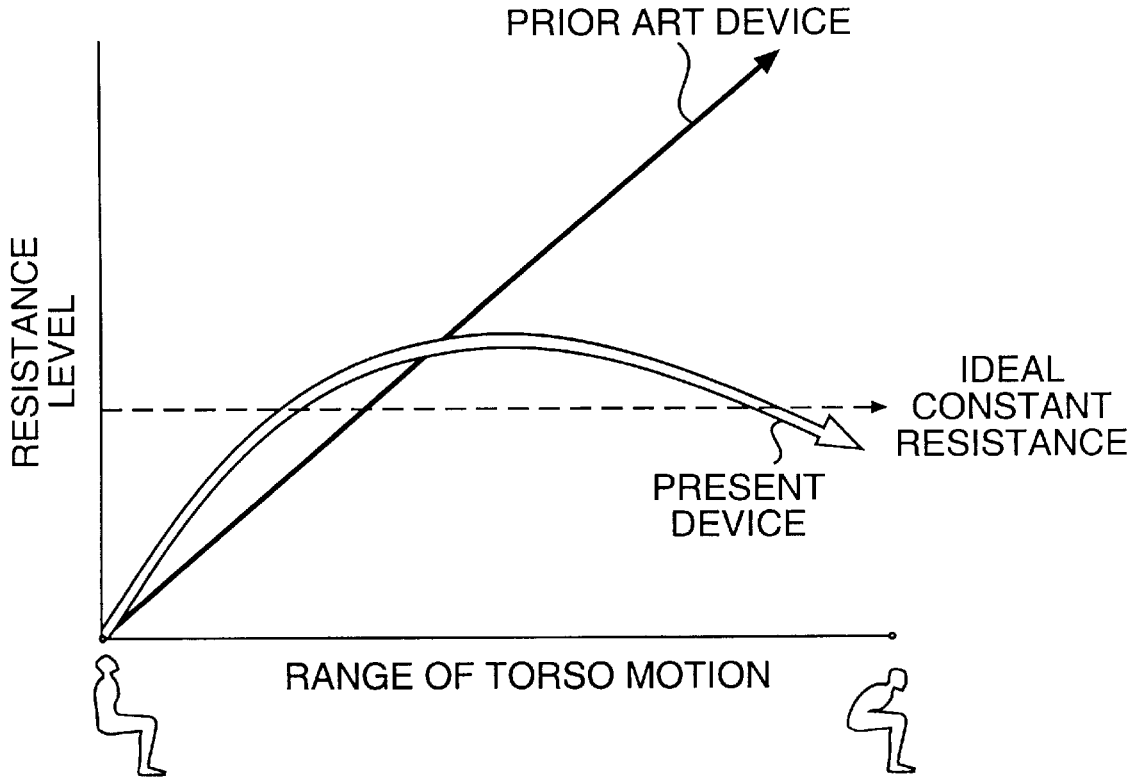
FIG. 9 is a comparative graph of the present exercise device having its variable resistance level plotted against its inherent range of motion and reflecting the difference between the varying resistance level of the present device as compared with the progressive resistance level of another device of the prior art patent to Miller '545.
Figure 10:
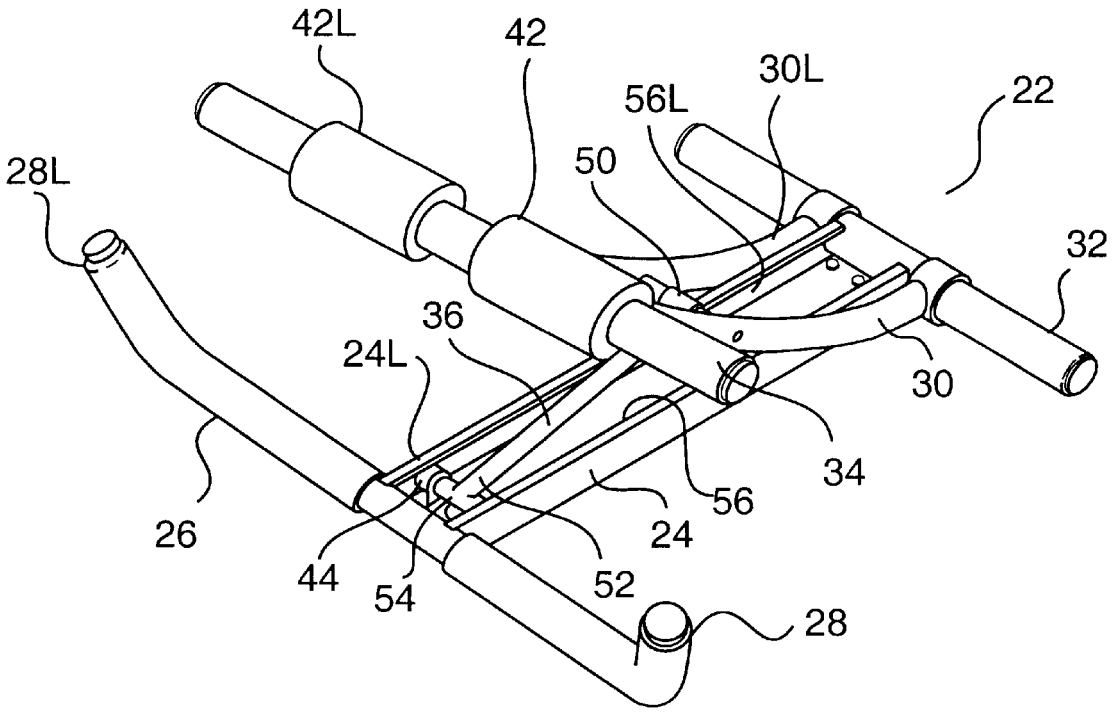
FIG. 10 shows the device of FIG. 5, converted from the operating mode, and folded up (tension band partly released), and made more portable for storage.

The conditioning advantage of the present invention over the abdominal-limited exercise device of Miller ('425) is shown in FIG. 9. The ideal constant resistance level is plotted diagrammatically, as resistance level vs. range of torso motion for the crunching exercise of FIG. 1. The linearly increasing resistance level of the prior art device is also plotted. The variable resistance level of the present device, as plotted, shows it to approach, follow broadly, a constant and desired resistance level. This operating feature fosters smoother and more uniform repetitions for the abdominal exercise, in particular, as compared to the prior art device.

DETAILED DESCRIPTION OF A SECOND EMBODIMENT

Figure 11:
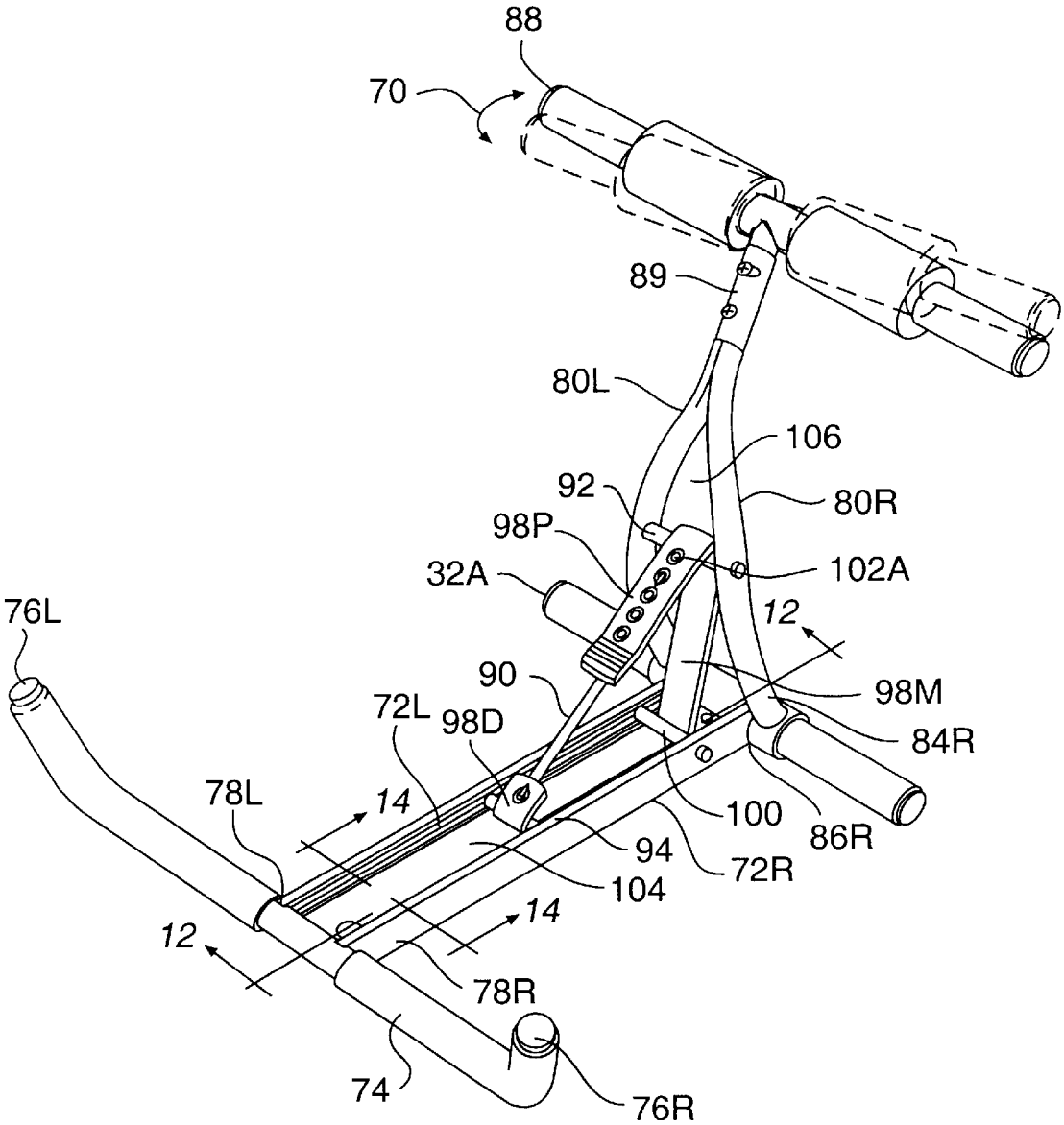
FIG. 11 is a perspective view of an alternate embodiment of the inventive device of FIG. 5, entailing a band tensioning means alternate to that first described, and shown in FIG. 5; and also providing an optional pivoting action for the upper cross bar member.

In the perspective view of FIG. 11, an alternate operative configuration for the portable exercise device, generally 70, is depicted. It includes a lap-supported, elongated pair of inwardly channeled, elongate sidewall members, 72L/R; a distal, elongate cross member 74, conveniently provided with upswept handles, 76L/R, which is secured centrally on the distal end 78L/R of the spaced-apart, sidewall members 72L/R. An upstanding pair of support members, 8OL/R, which are conveniently bowed and converging being somewhat spaced-apart, are secured at their lower longitudinal ends 84L/R, being conjoined to the proximal longitudinal ends, 86L/R, of sidewall members 72L/R. This upright pair 80L/R lie adjacent to the user upper torso (not seen). There is also provided an upper end, elongate cross member 88, for the upstanding members 80L/R, being secured centrally on the upper end 89 of upright pair 80L/R. An inclined spanner bar 90 is provided, which is functionally linked from strut-like cross member 92, located between the diverging gap of the upstanding pair, and extending down to, another strut-like cross member 94, which is adapted to move reciprocally within the open track defined by the opposing channels of the sidewall members 72L/R.

Figure 12:
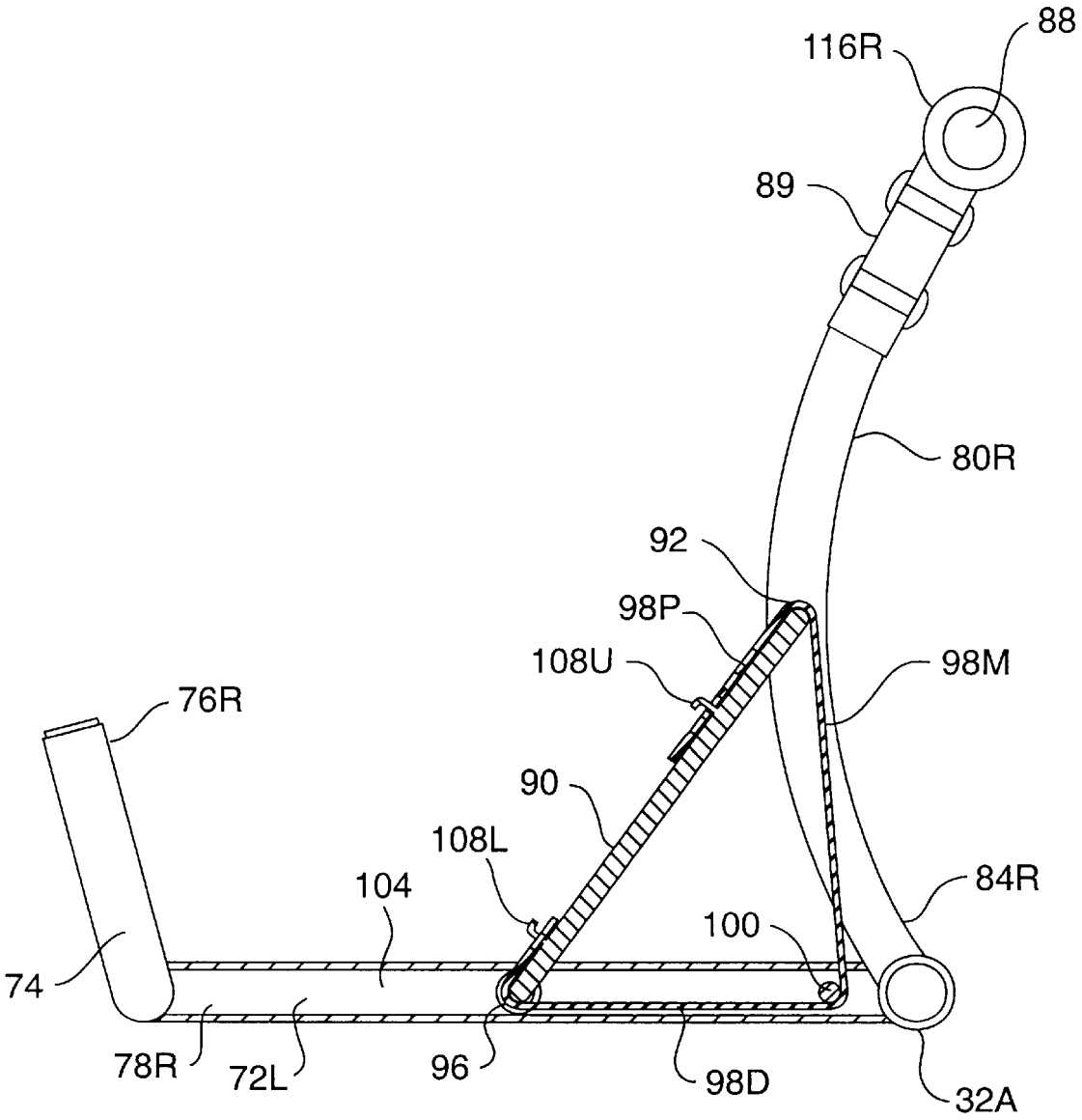
FIG. 12 is a vertical sectional view, taken along lines 12—12 in FIG. 11, of the operative components, particularly of the alternate tensioning band, which provides the counterforce to that force exerted by user movement of the fluted end gripping bars of the device.

A track-follower assembly 96 is operatively mounted to the lowermost end of strut 94, which assembly can then traverse the opposing channels (FIG. 14), as it is driven by the distal, upward pivoting action of spanner bar 90 about upper cross strut 92 (FIG. 11). Strung between upper cross strut 92 of upstanding members 80L/R at the one longitudinal end thereof, and extending to the track-follower assembly 96 at its other longitudinal end, is a flexible tensioning band 98 (FIG. 12). Band 98 is looped under a trough-straddling proximal strut 100, the latter being mounted centrally of lower cross bar 32A. Band 98 is anchored from cross strut 92 (extending to moving rollers) at one longitudinal end to the track-located, cross strut 94 at its other longitudinal end in FIG. 11.

In FIG. 11, the upper longitudinal end of band 98 is looped over upper strut 92 and extends to an intermediate point on the upper surface of spanner bar 98, to which it is secured. The upper band end 98P is provided with a number of axially-aligned perforations 102A–E (FIG. 11), which permit cinching of the tensioning band 98 to a resistance level suited to a particular user. The opposing longitudinal end 98D of band 98 extends within trough 104 and is looped around the distal lower strut 94, to be secured proximal to the distal lower end of spanner bar 98. This convoluted travel path of band 98 is better depicted in the vertical sectional view of FIG. 12. In effect, band 98 is located partially within trough 104 of the horizontal sidewall members, for much of its distal longitudinal segment, 98D, and is concurrently located partially within the upper transverse gap 106 (FIG. 11) of upright members 80L/R, for much of its intermediate length, 98M, and is located overlapping the upper segment of spanner bar 90 for the proximal (to torso) longitudinal segment, 98P.

The hooked studs, 108U/L (FIG. 12), on the outer surface of spanner bar 90 provide for interruptible securing of the longitudinal ends of tensioning band 98 to the opposing ends of bar 90. The device user (not seen) is seated while exercising with the device 70 tucked in between the usual knees to torso. The user's hands will then extend forwardly to grip the fluted ends, 76L/R, of gripping bar 74, and thus are positioned to activate the device. Other user positions are available as depicted in FIGS. 2/3. The depicted inclined spanner bar 90, through the aforementioned linkage, like gripping bar 74, is moved arcuately towards the upright members 80L/R, which smoothly draws the lower end of spanner bar 90, and its associated track follower assembly 96, distally (towards the outer end of channel members 72L/R). This permits the type of near idealized countervailing device resistance to user exertion as is depicted in FIG. 9, over the range of torso-to-arm motion.

Figure 13:
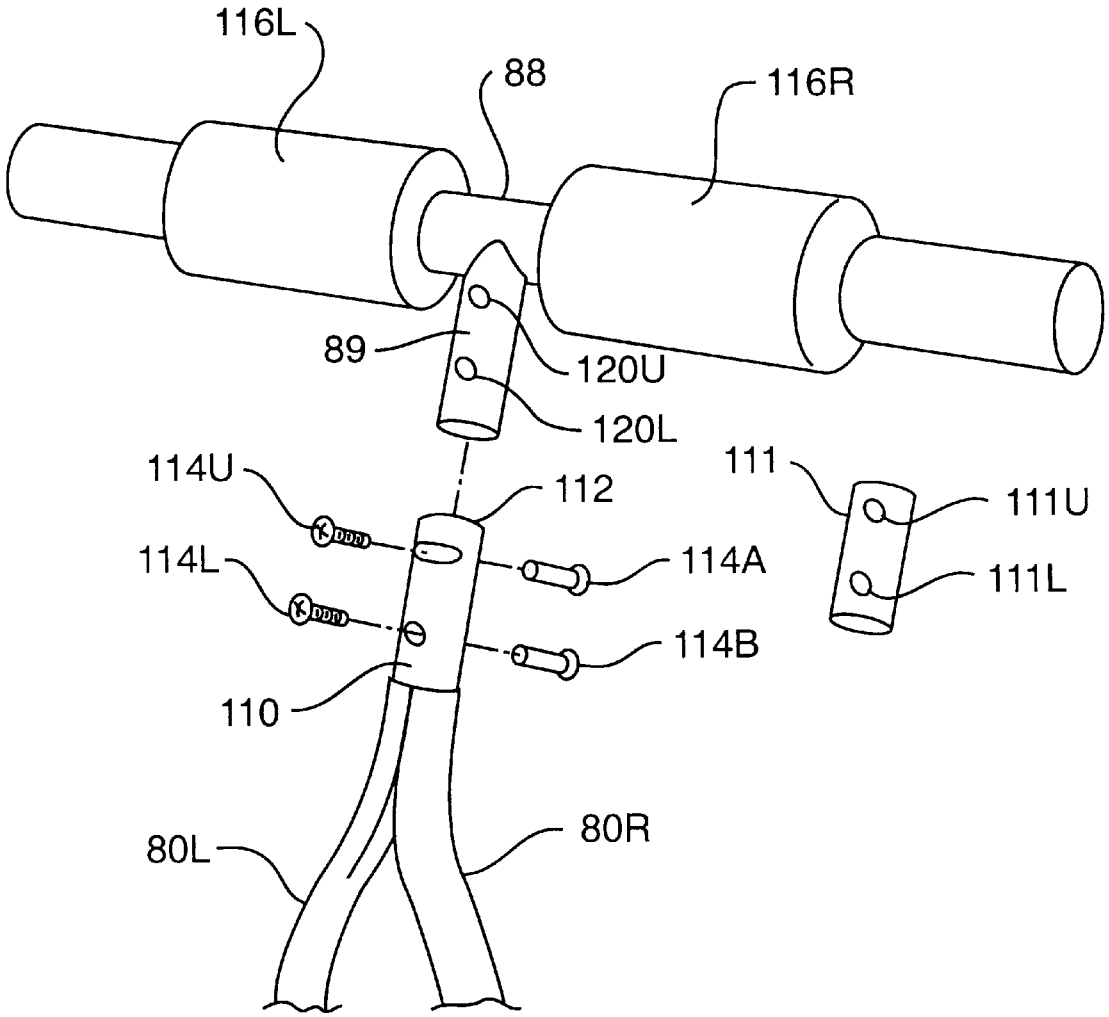
FIG. 13 is an exploded view of the upper end components of the crossbar element, and of converging upstanding members of FIGS. 5/11, but now modified to include a horizontal pivoting action for the cross bar member (FIG. 11)

In the broken out, perspective view of FIG. 13, is shown the upper segments of the inventive device, standing alone, but normally positioned in the use mode of FIG. 11. In other words, the upper ends of bowed member 80L/R converge and present a unitary tubular upper end 110 (FIG. 13). The arcuate surface of unitary tubular end 112 is provided with a horizontally-aligned, slot-like first perforation 114U, and an offset, vertically aligned, second perforation 114L. The upper end of cross member 88, having an optional cushioning sleeves 116L/R, also has a centrally located, downwardly oriented, tubular segment 89, which is dimensionally sized to telescopically engage the periphery of the upper rim 112 of unitary tubular member 110. The tubular segment is further provided with a pair of perforations, 120U/L, corresponding in alignment, and spacing, to those of undertube 110. A cylindrical rubber core 111 is sized for insertion within lower tubing 110, having aligned diametrical perforations 111U/L. It facilitates automatic self-control of cross bar 88. This permits the slot-like, second opening 120 to coincide with the slot-like first opening 114, and thus to receive, in sliding engagement, the shafts of a pair of elongate fastener means,114A and 114B. The resulting slotted engagement union serves to provide for a limited horizontal pivoting of cross bar 88, while abutting the torso of the device user (see FIG. 11), and enables the user to work the oblique muscles of the abdominals.

Figure 14:
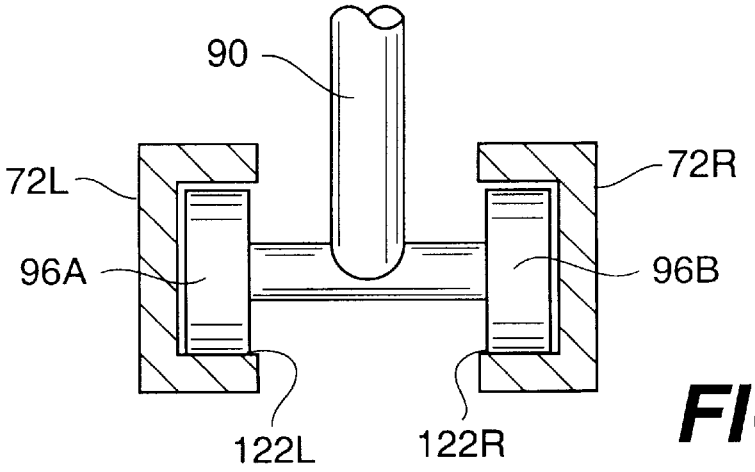
FIG. 14 is a transverse sectional view, taken along lines 14—14 of FIG. 11 (band omitted for clarity) depicting a first embodiment for the opposing dual channels that define the moving track for a reciprocating track-follower mechanism.

The transverse sectional view of FIG. 14 depicts the operative relation between the lower longitudinal end of spanner bar 90, and of associated cross strut 94. (Band 98 has been omitted for purposes of clarity of viewing). Strut 94 is axially connected to a pair of roller bearings 96A/B, which serve as the track follower assembly 96. Each of the spaced-apart, elongate support members 72L/R, presents an opposing inwardly facing channel, 127L/R. The latter channels provides the trackage for follower assembly 96, as it is horizontally driven outwardly by spanner bar 90. In operation, the band (not seen) is secured at its distal, longitudinal end proximal to the junction of bar 90 with cross strut 94.

Figure 15:
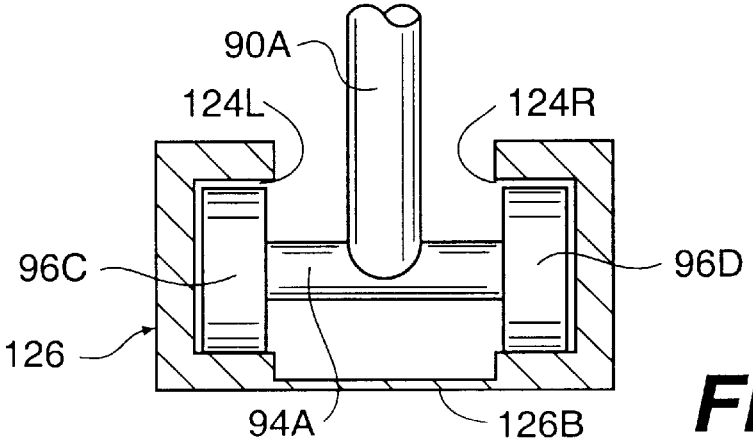
FIG. 15 is a second transverse vertical sectional view, depicting an alternate configuration for a unitary elongate channel member, serving as the track-follower trough of the device.

The like sectional view of FIG. 15 depicts strut 94A, track follower 96C/D, located functionally in dual channel 124L/R, which is defined by a unitary elongate member 126, having elongate rigid segment 126B bridging between the lower flanged edge of parallel channels 127L/R. It is within the skill of the metal fabricating arts to extrude a member of the depicted cross-sectional configuration, and cut it to suitable lengths for present purposes.

Figure 16:
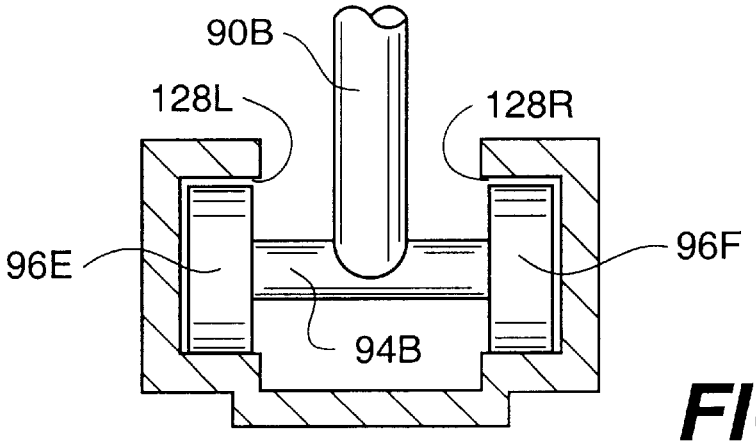
FIG. 16 is a third transverse vertical sectional view, depicting another configuration, also a unitary elongate channeled member for the track follower assembly.

In the transverse sectional view of FIG. 16, still another cross sectional configuration for the dual channel, elongate member 128L/R is depicted. It likewise can be fabricated by metal working, conveniently part stamping, and sized to appropriate lengths These latter two embodiments serve to enclose the otherwise exposed tensioning band 98 (FIG. 12), while providing an open upper surface longitudinal trough for band accessing for adjustment.

In another embodiment for the tensioning band of FIG. 12 (not depicted), tensioning bands would be paired, like industrial-strength rubber bands, and would be secured along the outer surfaces of the opposing sidewalls 72L/R (FIG. 11). Such would require, the addition of longitudinal slits on each sidewall to admit of the protruding axial extensions of the tracking assembly 96A/B of FIG. 14, that would serve as the distal anchor point for the longitudinal end of the tensioning band. At the other longitudinal end of the band, the anchor point would be fixed somewhat as is depicted in the embodiment of FIG. 5, yet differing in that the anchor points would be located on the outer sidewall members (72L/R of FIG. 11). The band anchor point would be located at the point of conjoining of proximal cross member 32 with each of upstanding members 30L/R. If bands are to be placed external of the sidewall members, 72L/R, they would necessarily be configured identically on both sidewall members for balanced operation.

An alternative embodiment to cross strut 100 seen in FIG. 12, would require a modified cross strut 100 to penetrate the center of a shaped lobe, or cam, which configuration would vary the stretch and resistance of tension band 98.

Figures 17, 18:
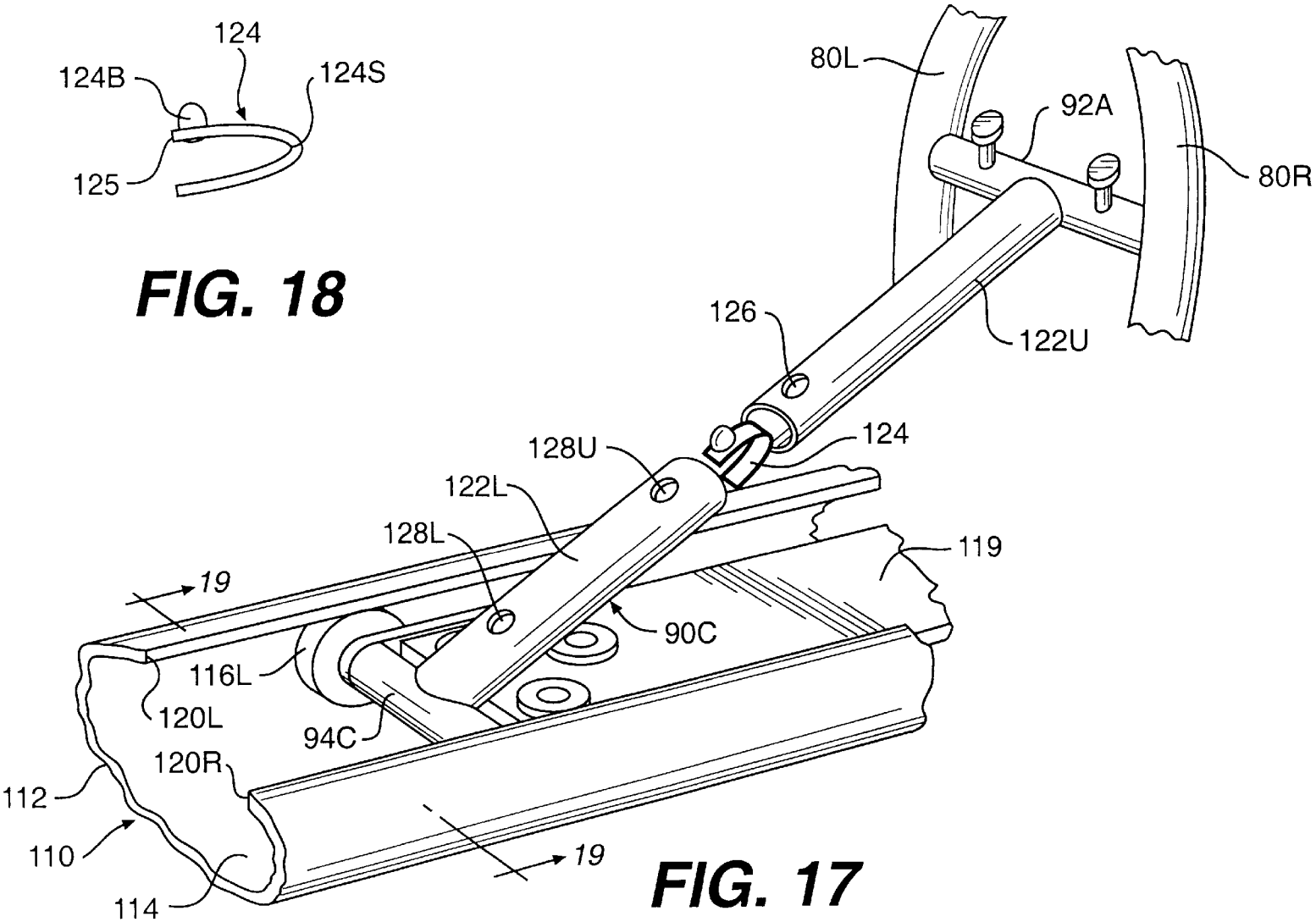
FIG. 17 is a broken away, perspective view of an alternate embodiment for the spanner bar tensioning mechanism 90/98 of FIG. 12.
FIG. 18 is a broken out view of a spring/button assembly employed with the embodiment of FIG. 18.
Figure 19:
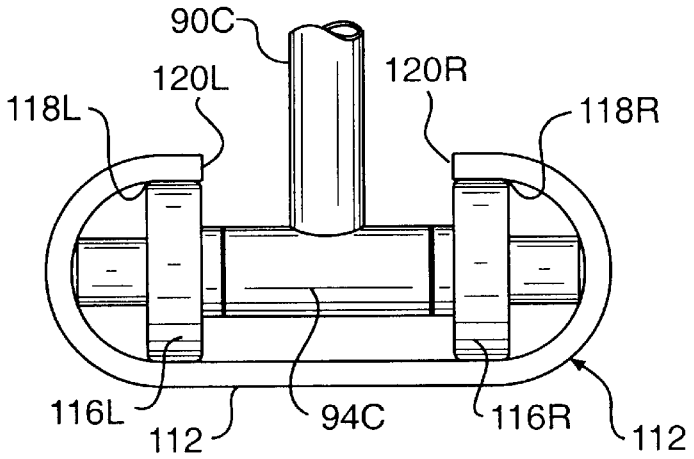
FIG. 19 is a vertical cross sectional view, taken along lines 19—19 of FIG. 17, depicting the transverse configuration of the elongate channel, and of the roller subassembly tracking therein.

The opposing sidewall members, 72L/R, which define elongate channel 104 in FIG. 11, have been functionally substituted for by the assembly 110 of FIG. 17. The tracking channel now comprises an oval-shaped member 112 with an open planar upper section, defining trough 114, that extends between and connects distal cross bar 94A to proximal cross strut 92A. (FIG. 11)

Figure 20:
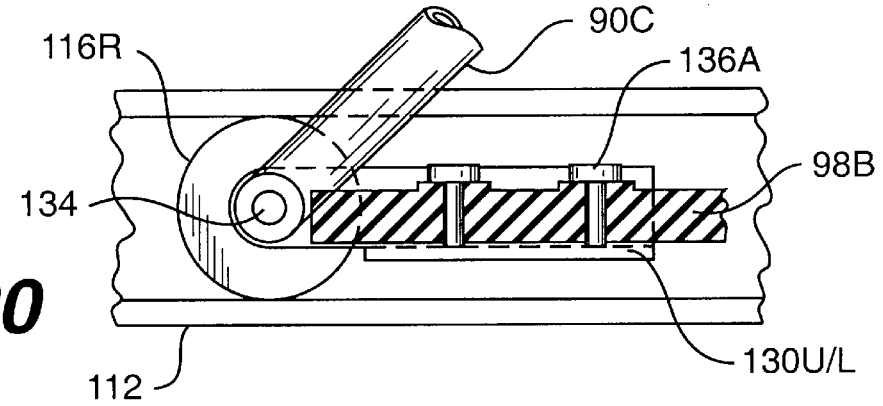
FIG. 20 is a broken away, side elevational view of the rollers and of the alternate tensioning mechanism.
Figure 21:
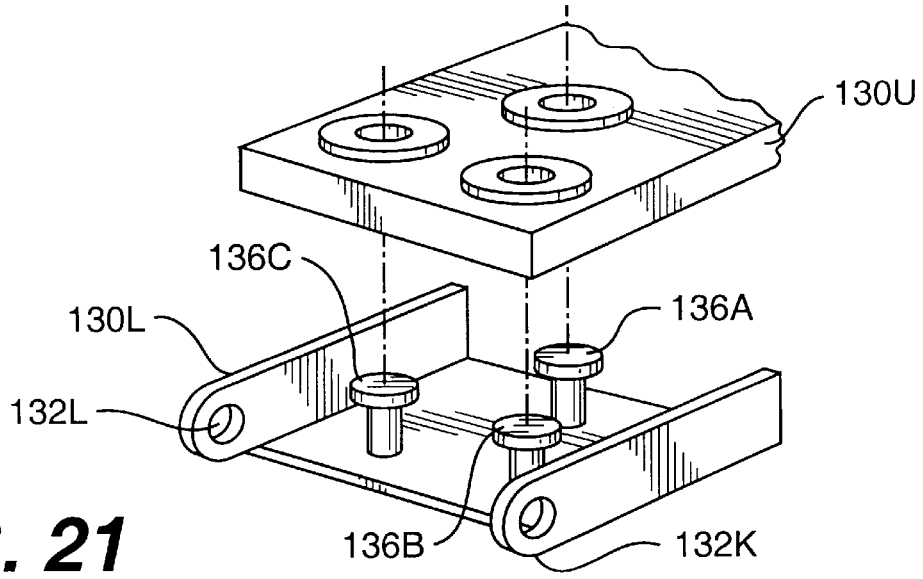
FIG. 21 is a broken away, perspective view of a hanger bracket for the distal longitudinal end of the tensioning band.

A modified track-follower assembly 90C is now mounted upon transverse strut 94C, which, in turn, is integrally pinned to inclined spanner bar segment 90C. The spaced apart, pair of rollers, 116L/R, have a slightly arcuate periphery, 118L/R, which slidingly engages the opposing arcuate lips, 120L/R of track member 112. Transverse strut 94C is driven reciprocally by inclined rigid rod 90C (FIG. 20). The rollers are of a composite material and the oval bracket member 112 is preferably of 3 mm gauge steel.

Spanner rod 90C is itself of a different configuration from that of integral rod 90A of the earlier embodiments, as is now depicted in FIG. 17. Rod 90C comprises two cylindrical tubes 122L/U, which are sized dimensionally so that the upper tube 122U is adapted to slidingly telescope within lower tube 122L, but only to a controlled degree. Mounted within the lower longitudinal end of upper tube 122U is a spring and button assembly 124 (FIG. 18); planar spring element 124S is hairpin-shaped, and has a finger button element 124B, mounted proximal to its upper longitudinal end 125. The button assembly 124 is anchored within the tube 122U by a peripheral fastener 126 (FIG. 17). Lower tube 122L is provided with a pair of spaced apart, linearly aligned, circular perforations, 128U/L. These perforations set the degree of telescopic engagement of upper tube 122U within lower tube 122L.

The telescope position of FIG. 17 (button 124B in perforation 128L) provides about a 90° angle between the pivoted members 24 and 30, for use in either of their seated position exercises of FIGS. 1 and 2. As in the earlier embodiments, the upper longitudinal end of upper tube 122U is pivotally mounted to cross strut 92A while tube 122L is pinned to cross strut 94A. A first telescoped position (not seen) is for a user in the layback position; elongate members 24 and 30 can be expanded to a 140° obtuse angle, at rest, while button 124B engages perforation 128U.

In FIG. 20, the distal end of band 98B is clamped in two-element axle bracket 130U/L. The lower bracket 130L has a pair of axially aligned perforations 132L/R, which engage the axle 134 of the tracking assembly 94A. Brads 136A/B/C (FIG. 20) fasten the belt 98B at the longitudinal end of the bracket and the tracking assembly 130. This mode of interconnection keeps tensioning band 98B from drooping, allowing for either a closed trough 112 or button cover (not seen) to be positioned under the tracking assembly 94A.

I claim:

1. A multifunctional, portable, lap-based exercise device comprising:

(a) a first pair of spaced-apart, elongate parallel rigid members defining a substantially uniform, linear trough having a proximal-to-the-user torso first longitudinal end and a distal second longitudinal end;

(b) a linear channel disposed lengthwise of the inner surface of each of the opposing surfaces of the first pair and serving to provide a dual channel, linear track;

(c) a first cross strut, which straddles the linear trough located distally between the parallel members of the first pair;

(d) a spaced-apart, upstanding, second pair of rigid members being secured attached at their lower longitudinal ends to the proximal longitudinal ends of the first pair of members;

(e) a second cross member aligned transversely at the junction of the first and second pairs of members and adapted to afford lateral stability to the device while same is positioned in the lap of a user;

(f) a third cross member aligned transversely at the upper longitudinal ends of the second pair of members and adapted to be anchored centrally thereof, so to afford added lateral stability to the device while positioned in the user lap;

(g) a short fourth cross member located straddling the transverse gap defined by the spaced-apart members of the second pair and positioned intermediate of their longitudinal ends;

(h) a single rigid spanning bar connected pivotally at its upper longitudinal end to the fourth cross member and connected pivotally at its lower longitudinal end to the first cross strut;

(i) a fifth cross member secured across the distal longitudinal ends of said first pair of members and providing a manually grippable means serving to activate the exercise device;

(j) a track-follower assembly pivotally attached to the first cross strut, which assembly operatively traverses the dual channel of said first pair, as driven by said fifth cross member and being secured centrally thereof;

(k) a variably aligned, axially-movable resilient tensioning band with the distal band segment being anchored at its longitudinal end to the track-follower assembly and with the proximal band segment being anchored at its opposing longitudinal end to the first cross strut; and (l) a second cross strut straddling between the first pair of rigid members, located proximal to the second cross member, and being in a sliding engagement with the width of the movable band, which strut serves as a translation point for the reciprocating change of direction of the band during device use;

whereby upon manually drawing inwardly the fifth cross member along an inherent arcuate range of motion, the spanning bar thereby moves the follower assembly somewhat distally along the linear track, against the countervailing tension imposed thereon by the operatively-connected tensioning band upon manual release, and conversely permitting the track follower assembly to return to its at rest position.

2. The device according to claim 1 wherein said second pair of members are provided with an arcuate bowing along their intermediate length.

3. The device according to claim 1 wherein the track-follower assembly is provided with laterally aligned, pair of roller means, which roller means traverses the linear channels of said first pair of members.

4. The device according to claim 1 wherein the third cross member is provided with sleeve-like cushion elements.

5. The device according to claim 1, wherein the fifth cross member is provided with upwardly oriented, longitudinal ends for convenient manual gripping.

6. The device according to claim 1, wherein the upper longitudinal ends of the second pair of upstanding members present a generally cylindrical, rigid tubular end, the arcuate surface of which end is provided with a horizontally-aligned, slot-like first opening, positioned proximal to the upper rim of the tubular end, and which slot is adapted to receive an elongate fastener means therethrough; and the associated second cross member is adapted to include a centrally located, integral tubular sleeve element that is dimensionally sized to telescopically engage the periphery of the rim of the upper tubular end, with the superimposed tubular sleeve also having a slot-like second opening also being located peripherally, so as to coincide with the first opening, and thus to receive, in sliding engagement, the shaft of the elongate fastener means, whereby the third cross member is thusly adapted to provide for limited horizontal pivoting while abutting the moving torso of the device user.

7. The device of claim 6 wherein the rigid tubular end of the second pair is provided with a sized, resilient cylindrical core adapted for sliding insertion therein and which facilitates automatic self-centering of the third cross member.

8. The device of claim 1 wherein the first pair of rigid members are formed as a unitary member having a rigid elongate segment bridging between the lower flanged edges of the opposing parallel channels.

9. The device of claim 1 wherein the tensioning band is located partially within the trough defined by the first pair of rigid members for its distal longitudinal segment and concurrently being located partially within the transverse gap defined by the upstanding, second pair for its proximal longitudinal segment.

10. A multifunctional, portable, lap-based exercise device comprising:

(a) a first pair of spaced-apart, elongate parallel rigid members defining a substantially uniform, linear trough having a proximal-to-the-user torso first longitudinal end and a distal second longitudinal end;

(b) a linear channel disposed lengthwise of the inner surface of each of the opposing surfaces of the first pair and serving to provide a dual channel, linear track;

(c) a first cross strut, which straddles the linear trough located distally between the parallel members of the first pair;

(d) a spaced-apart, upstanding, second pair of rigid members being secured attached at their lower longitudinal ends to the proximal longitudinal ends of the first pair of members;

(e) a second cross member aligned transversely at the junction of the first and second pairs of members and adapted to afford lateral stability to the device while same is positioned in the lap of a user;

(f) a third cross member aligned transversely at the upper longitudinal ends of the second pair of members and adapted to be anchored centrally thereof, so to afford added lateral stability to the device while positioned in the user lap;

(g) a short fourth cross member located straddling the transverse gap defined by the spaced-apart members of the second pair and positioned intermediate of their longitudinal ends;

(h) a spanning bar connected pivotally at its upper longitudinal end to the fourth cross member and connected pivotally at its lower longitudinal end to the first cross strut, said bar comprising a pair of linear tubular members having one member sized dimensionally to telescopically engage the other tubular member to a controlled degree, which is effected by a mechanism that interruptibly interconnects the opposing inner ends of said members;

(i) a fifth cross member secured across the distal longitudinal ends of said first pair of members and providing a manually grippable means serving to activate the exercise device;

(j) a track-follower assembly pivotally attached to the first cross strut, which assembly operatively traverses the dual channel of said first pair, as driven by said fifth cross member and being secured centrally thereof;

(k) a variably aligned, axially-movable resilient tensioning band with the distal band segment being anchored at its longitudinal end to the track-follower assembly and with the proximal band segment being anchored at its opposing longitudinal end to the first cross strut; and (l) a second cross strut straddling between the first pair of rigid members, located proximal to the second cross member, and being in a sliding engagement with the width of the movable band, which strut serves as a translation point for the reciprocating change of direction of the band during device use;

whereby upon manually drawing inwardly the fifth cross member along an inherent arcuate range of motion, the spanning bar thereby moves the follower assembly somewhat distally along the linear track, against the countervailing tension imposed thereon by the operatively-connected tensioning band upon manual release, and conversely permitting the track follower assembly to return to its at rest position.

* * * * *